US010576650B2

(12) United States Patent
Bayer et al.

(10) Patent No.: US 10,576,650 B2
(45) Date of Patent: Mar. 3, 2020

(54) CORRUGATED CARDBOARD PLANT

(71) Applicant: BHS Corrugated Maschinen- und Anlagenbau GmbH, Weiherhammer (DE)

(72) Inventors: Friedrich Bayer, Hirschau (DE); Christian Mühlbach, Kaltenbrunn (DE)

(73) Assignee: BHS Corrugated Maschinen- und Anlagebau GmbH, Weiherhammer (DE)

( * ) Notice: Subject to any disclaimer, the term of this patent is extended or adjusted under 35 U.S.C. 154(b) by 107 days.

(21) Appl. No.: 15/879,924

(22) Filed: Jan. 25, 2018

(65) Prior Publication Data

US 2018/0215061 A1 Aug. 2, 2018

(30) Foreign Application Priority Data

Jan. 27, 2017 (DE) ..... 10 2017 201 371

(51) Int. Cl.
*B26D 5/32* (2006.01)
*B26D 1/40* (2006.01)
(Continued)

(52) U.S. Cl.
CPC ..... *B26D 5/32* (2013.01); *B26D 1/405* (2013.01); *B26D 5/005* (2013.01); *B26D 5/007* (2013.01);
(Continued)

(58) Field of Classification Search
USPC ..... 162/194
See application file for complete search history.

(56) References Cited

U.S. PATENT DOCUMENTS 3,058,869 A 10/1962 Irwin et al.
6,071,222 A * 6/2000 Schneider ..... B26D 1/245 493/355
(Continued)

FOREIGN PATENT DOCUMENTS

DE 10 2004 003 560 A1 8/2005
DE 10 2015 204 407 A1 9/2016
JP 2002 273 800 A 9/2002

OTHER PUBLICATIONS

US 2015/053349 A1, which has been previously disclosed in the Information Disclosure Statement of Jan. 25, 2018. The reference is cited in the European search report under Category X as being relevant to claims 1, 3, 5 and 11 and under Category A as being relevant to claims 2, 3, 6-10.
(Continued)

*Primary Examiner* — Mark Halpern
(74) *Attorney, Agent, or Firm* — McGlew and Tuttle, P.C.

(57) ABSTRACT

A corrugated cardboard plant comprises a corrugated cardboard web production assembly for producing a corrugated cardboard web; a register mark cutting device, disposed downstream of the corrugated cardboard web production assembly, for cutting the corrugated cardboard web into corrugated cardboard sheets; a register mark detection device, disposed upstream of the register mark cutting device, for detecting at least one register mark on the corrugated cardboard web; and a control assembly which is in signal connection with the register mark cutting device and with the register mark detection device, and depending on the at least one detected register mark actuates the register mark cutting device, while generating at least one register mark cut. The corrugated cardboard plant furthermore has a register mark cut position correction installation for the automatic correction of the position of the at least one register mark cut in relation to the at least one register mark
(Continued)

in the case of an undesirable deviation of the position of the at least one register mark cut.

17 Claims, 6 Drawing Sheets

(51) Int. Cl.

| | |
|---|---|
| ***B31F 1/28*** | (2006.01) |
| ***B26D 5/00*** | (2006.01) |
| ***B26D 7/32*** | (2006.01) |
| ***B26D 11/00*** | (2006.01) |
| ***B31F 1/20*** | (2006.01) |

(52) U.S. Cl.
CPC ..... *B26D 7/32* (2013.01); *B26D 11/00* (2013.01); *B31F 1/20* (2013.01); *B31F 1/2822* (2013.01); *B31F 1/2831* (2013.01)

(56) References Cited

U.S. PATENT DOCUMENTS

2004/0182503 A1* 9/2004 Stadele ..... B31F 1/2822 156/210
2005/0209075 A1 9/2005 Kocherga et al.
2014/0000785 A1* 1/2014 Gnan ..... B31F 1/20 156/64
2015/0053349 A1 2/2015 Mori et al.

OTHER PUBLICATIONS

US 2005/209075 A1, which has been previously disclosed in the Information Disclosure Statement of Jan. 25, 2018. The reference is cited in the European search report under Category X as being relevant to claims 1 and 11 and under Category A as being relevant to claims 2-10.
US 3,058,869 A, which has been previsouly disclosed in the Information Disclosure Statement of Jan. 25, 2018. The reference is cited in the European search report under Category X as being relevant to claims 1, 5 and 11 under Category A as being relevant to claims 2-4 and 6-10.
JP 2002 273800 A, which has been previously disclosed in the Information Disclosure Statement of Jan. 25, 2018. The referene is cited in the European search report under Category A as being relevant to claims 1-11.

* cited by examiner

CORRUGATED CARDBOARD PLANT

CROSS-REFERENCE TO RELATED APPLICATIONS

This patent application claims priority of German Patent Application Serial No. DE 10 2017 201371.0, filed on Jan. 27, 2017, pursuant to 35 U.S.C. 119 (a)-(d), the content of which is incorporated herein by reference in its entirety as if fully set forth herein.

FIELD OF THE INVENTION

The invention relates to a corrugated cardboard plant for producing corrugated cardboard sheets. The invention furthermore relates to a method for producing corrugated cardboard sheets.

BACKGROUND OF THE INVENTION

Corrugated cardboard plants in general are known from the prior art.

SUMMARY OF THE INVENTION

The invention is based on the object of achieving an improved corrugated cardboard plant. In particular, the corrugated cardboard plant is to be capable of generating in an extremely precise manner individual corrugated cardboard sheets from an in particular endless corrugated cardboard web. A corresponding method is moreover to be provided.

This object is achieved according to the invention by a corrugated cardboard plant, comprising a corrugated cardboard web production assembly for producing a corrugated cardboard web; a register mark cutting device, disposed downstream of the corrugated cardboard web production assembly, for cutting the corrugated cardboard web into corrugated cardboard sheets; a register mark detection device, disposed upstream of the register mark cutting device, for detecting at least one register mark on the corrugated cardboard web; a control assembly which is in signal connection with the register mark cutting device; is in signal connection with the register mark detection device; and depending on the at least one detected register mark actuates the register mark cutting device for cutting the corrugated cardboard web into the corrugated cardboard sheets, while generating at least one register mark cut; and a register mark cut position correction installation for automatic correction of a position of the at least one register mark cut in relation to the at least one register mark in the case of an undesirable deviation of a position of the at least one register mark cut. Furthermore this object is solved by a method for production of corrugated cardboard sheets, comprising producing a corrugated cardboard web by means of a corrugated cardboard web production assembly; cutting the corrugated cardboard web into corrugated cardboard sheets by a register mark cutting device that is disposed downstream of the corrugated cardboard web production assembly; detecting at least one register mark on the corrugated cardboard web by means of a register mark detection device which is disposed upstream of the register mark cutting device; actuating the register mark cutting device for cutting the corrugated cardboard web into the corrugated cardboard sheets by means of a control assembly depending on the at least one detected register mark by generating at least one register mark cut, wherein the control assembly is in signal connection with the register mark cutting device and the register mark detection device; and automatically correcting a position of the at least one register mark cut in relation to the at least one register mark in the case of an undesirable deviation of a position of the at least one register mark cut by means of a register mark cut position correction installation The at least one detected register mark triggers the register mark cutting device. The core of the invention lies in that an automatic or self-acting, respectively, correction of the position of the at least one register mark cut is performed if required by means of the register mark cut position correction installation, this being extremely economical. In particular, the correction of the position is performed while the corrugated cardboard plant is running In the operation of corrugated cardboard plants of the prior art, an offset of the at least one register mark cut in the direction of the transportation of the corrugated cardboard web or corrugated cardboard sheets, respectively, or counter to said transportation direction, respectively, has repeatedly arisen, this being avoided according to the invention.

It is advantageous for the register mark cutting device to correspondingly convert the correction of the position of the at least one register mark cut in or counter to, respectively, the transportation direction of the corrugated cardboard web or of the corrugated cardboard sheets, respectively, immediately or at once, respectively, such that the subsequent register mark cuts or corrugated cardboard sheets, respectively, correspond exactly to a nominal parameter. The corrugated cardboard sheets generated in the transportation direction have a length which corresponds exactly to the nominal parameter. The register mark cutting device is preferably activatable so as to be independent of any fixed chopping length.

The at least one register mark is favourably disposed so as to be peripheral in relation to the corrugated cardboard web. It is advantageous for the at least one register mark to be printed onto the corrugated cardboard web. Said at least one register mark is formed by at least one bar or a cross, for example. Alternatively, the at least one register mark is formed, for example, by at least one slot, a RFID component, or the like. A multiplicity of register marks are favourably present, said register marks in the transportation direction of the corrugated cardboard web or corrugated cardboard sheets, respectively, being disposed so as to be mutually spaced apart.

The register mark detection device favourably operates in a non-contacting manner Said register mark detection device is preferably an optical register mark detection device.

It is advantageous for the register mark cutting device to be embodied as a transverse cutting device. It is expedient for said transverse cutting device to have at least one rotatably driveable roller having at least one blade that runs in a radial manner The control assembly is preferably an electrical or electronic, respectively, control assembly. The signal connections are embodied so as to be wireless or wire-bound, for example. Said signal connections preferably exist at least temporarily. Signals are favourably transmittable by way of the signal connections. The control assembly is in direct or indirect signal connections with the register mark cutting device and/or with the register mark detection device.

It is advantageous for the register mark cut position correction installations to be a component part of the control assembly. Alternatively, said register mark cut position correction installation is a component part of the register mark cutting device, for example.

The register mark cutting device favourably comprises at least two register mark cutting installations for cutting part-webs of the corrugated cardboard web. It is advantageous for the register mark detection device to have at least two register mark detection installations for detecting at least one register mark on part-webs of the corrugated cardboard web.

The corrugated cardboard web production assembly is preferably capable of generating multi-ply, in particular three-ply, five-ply, or seven-ply corrugated cardboard webs. To this end, said corrugated cardboard web production assembly favourably comprises at least one device for the production of a unilaterally laminated corrugated cardboard web. The corrugated cardboard web preferably has at least one smooth cover web, one smooth laminate web, and one interposed corrugated web.

The terms "disposed upstream", "disposed downstream", "upstream", "downstream", or the like, used here refer in particular to a transportation direction of the corrugated cardboard web or of the corrugated cardboard sheets.

The register mark cut detection assembly is favourably embodied as an optical register mark cut detection assembly. At least one register mark cut detection installation of the register mark cut detection assembly for detecting the at least one register mark cut in the respective corrugated cardboard web is preferably disposed downstream of each register mark cutting installation of the register mark cutting device, for detecting the at least one register mark cut.

The register mark cut detection assembly is embodied as a camera assembly. Other configurations are alternatively possible.

The register mark cut detection assembly comprises a register mark cut detection installation, facing an upper side of the corrugated cardboard sheets, for detecting the upper side of the corrugated cardboard sheets, and a further register mark cut detection installation, facing a lower side of the corrugated cardboard sheets, for detecting the lower side of the corrugated cardboard sheets. The register mark cut detection installations assigned to the corrugated cardboard web are favourably disposed so as to be mutually opposite. The corrugated cardboard web is preferably guided through between said register mark cut detection installations.

The register mark cut position evaluation installation for evaluating a position of the at least one register mark cut in relation to the at least one associated register mark is favourably a component part of the control assembly. Said register mark cut position evaluation installation is preferably of an electrical or electronic type, respectively.

The register mark cut position evaluation installation comprises an image processing unit which favourably utilises respective image processing software. The image recorded of the at least one register mark cut is preferably processed in said image processing unit.

The register mark cut position correction installation is in direct or indirect signal connection with the register mark cut position evaluation installation and the register mark cutting device.

A nominal value or a tolerance, respectively, is predefinable to the register mark cut position correction installation by way of the nominal interval parameter unit for correcting a position of the at least one register mark cut in the case of a deviation from a nominal interval.

A preferred embodiment of the invention will be described in an exemplary manner hereunder with reference to the appended drawing.

DESCRIPTION OF THE PREFERRED EMBODIMENT

Figure 1:
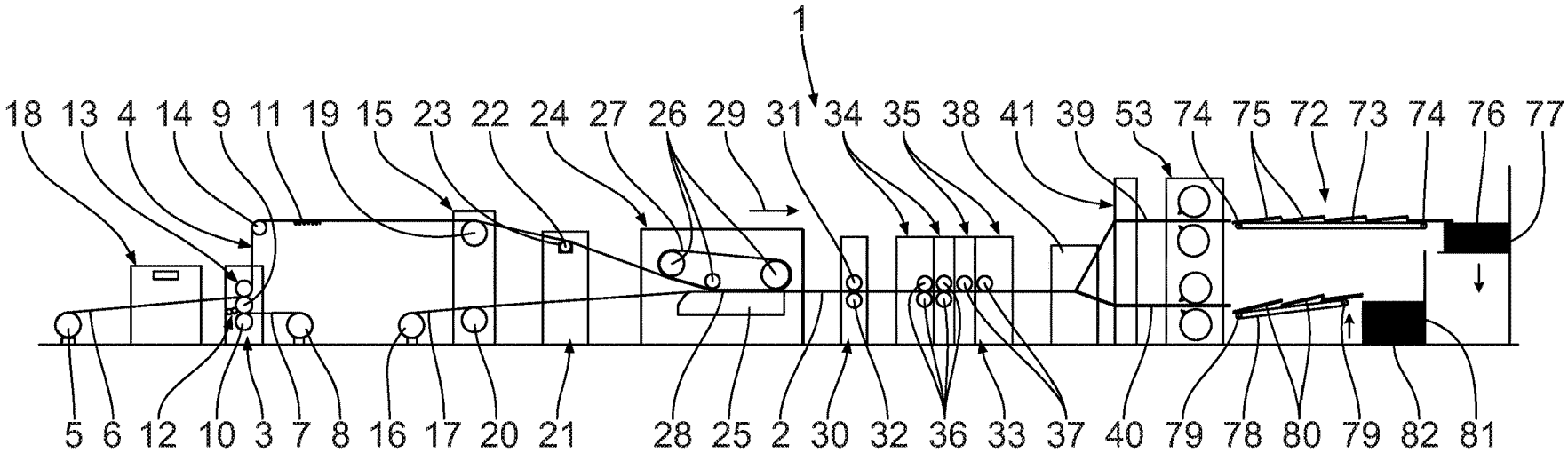
FIG. 1 shows a schematic side view of a corrugated cardboard plant according to the invention.

A corrugated cardboard plant as is visualized in the entirety thereof in a simplified manner in FIG. 1 comprises a corrugated cardboard web production assembly 1 for the production of an endless corrugated cardboard web 2. The corrugated cardboard web production assembly 1 has a device 3 for the production of a unilaterally laminated corrugated cardboard web 4.

A first material web 6 is supplied to the device 3 for the production of the unilaterally laminated corrugated cardboard web 4 from a first unwinding installation 5. A preheating device 18 for preheating the first material web 6 is located between the first unwinding installation 5 and the device 3 for the production of the unilaterally laminated corrugated cardboard web 4.

In the device 3 for the production of the unilaterally laminated corrugated cardboard web 4 the first material web 6 is combined with a second material web 7 which is unwound from a second unwinding installation 8.

The material webs 6, 7 are preferably endless. To this end, the unwinding installations 5, 8 favourably have respective splicing units (not illustrated).

In the device 3 for the production of the unilaterally laminated corrugated cardboard web 4, the second material web 7 for generating a corrugation is guided between a first and a second fluted roller 9, 10, said fluted rollers being disposed so as to be mutually adjacent and rotating about the axes thereof when corrugating. After passing therethrough, the second material web 7 is present as a corrugated web 11.

The tips of the corrugated web 11 are subsequently provided with glue by a gluing installation 12 which is a component part of the device 3 for the production of the unilaterally laminated corrugated cardboard web 4.

The corrugated web 11 that is provided with glue, and the first material web 6, are then compressed and adhesively interconnected in the device 3 for the production of the unilaterally laminated corrugated cardboard web 4 in a gap between the first fluted roller 9 which is disposed above the second fluted roller 10, and a compression installation 13, while forming the unilaterally laminated corrugated cardboard web 4.

The unilaterally laminated corrugated cardboard web 4 that is formed from the material webs 6, 7 is then guided out of the device 3 for the production of the unilaterally laminated corrugated cardboard web 4 and guided about a deflection roller 14 to a pre-heating device 15 of the corrugated cardboard web production assembly 1.

The corrugated cardboard web production assembly 1 moreover has a third unwinding installation 16 for a third, preferably endless, material web 17. The third material web 17 forms a lamination web for the unilaterally laminated corrugated cardboard web 4. The third material web 17 is also supplied to the pre-heating device 15.

The pre-heating device 15 has two heatable heating rollers 19, 20 that are disposed on top of one another. The unilaterally laminated corrugated cardboard web 4 and the third material web 17 in the pre-heating device 15 run on top of one another so as to be spaced apart and in regions on the outer side contact the respective heating roller 19 or 20, respectively.

The corrugated cardboard web production assembly 1 furthermore comprises a gluing unit 21 which is disposed downstream of the pre-heating device 15. The gluing unit 21 has a gluing roller 22 which is partially submerged in a glue bath 23. The unilaterally laminated corrugated cardboard web 4 by way of the corrugated web 11 thereof is in contact with the gluing roller 22 such that glue from the glue bath 23 is transferred to the corrugated web 11, in particular to the tips of the latter.

The corrugated cardboard web production assembly 1 moreover has a heat compression device 24 which is disposed downstream of the gluing unit 21. The heat compression device 24 comprises a horizontal table 25 that is provided with heating elements (not illustrated). The heat compression device 24 above the table 25 has an endless compression belt 27 that is guided about rollers 26. A compression gap 28 through which the unilaterally laminated corrugated cardboard web 4 and the third material web 17 are transported and therein are mutually compressed is configured between the compression belt 27 and the table 25. The endless corrugated cardboard web 2 which according to this preferred embodiment has three plies and is continuously transported in a transportation direction 29 is formed in the heat compression device 24.

The corrugated cardboard plant, downstream of the heat compression device 24 in relation to the transportation direction 29, has a short transverse cutting device 30. The short transverse cutting device 30 has a blade cylinder 31 and a counter cylinder 32 that is disposed below the former. The blade cylinder 31 and the counter cylinder 32 are rotatably mounted, wherein the rotation axes thereof run mutually parallel and perpendicularly to the transportation direction 29 of the endless corrugated cardboard web 2.

The blade cylinder 31 has a cylinder jacket to which a blade (not illustrated) having a cutting edge is fastened. The counter cylinder 32 also has a cylinder jacket to which a counter blade (not illustrated) having a cutting edge is attached.

Furthermore, a row of counter member elements (not illustrated) which are displaceable between two detents (not illustrated) that are fastened to the cylinder jacket and project radially therefrom are disposed on the cylinder jacket of the counter cylinder 32.

The short transverse cutting device 30 is capable of generating a cut which extends across the full width of the endless corrugated cardboard web 2. To this end, the blade cylinder 31 and the counter cylinder 32 are set in rotation in such a manner that said cylinders, or the blades thereof, respectively, mutually interact in the cutting procedure.

The short transverse cutting device 30 is furthermore capable of generating a cut having a specific length and having a specific spacing from a longitudinal periphery of the endless corrugated cardboard web 2. To this end, the counter member elements are chosen or adjusted in a corresponding manner, respectively. For the cutting procedure, the blade cylinder 31 and the counter cylinder 32 are set in rotation in such a manner that the blade of the blade cylinder 31 interacts with the counter member elements. Reference is made to DE 10 2004 003 560 A1 in terms of the detailed construction of the short transverse cutting device 30 and the functioning thereof. The short transverse cutting device 30 in terms of construction can also be of a different configuration or be absent.

The corrugated cardboard plant, downstream of the short transverse cutting device 30 in relation to the transportation direction 29, has a longitudinal cutting/grooving device 33 which comprises two successively disposed grooving stations 34 and two successively disposed longitudinal cutting stations 35. Each grooving station 34 has two grooving tools 36 that are disposed on top of one another in pairs, the endless corrugated cardboard web 2 being guided therebetween. Each longitudinal cutting station 35 has a rotatably driveable blade 37 which for longitudinally severing the endless corrugated cardboard web 2 can be brought to engage with the latter.

The corrugated cardboard plant, downstream of the longitudinal cutting/grooving device 33 in relation to the transport direction 29, comprises a turnout 38 in which an endless longitudinally cut first web portion 39 and an endless longitudinally cut second web portion 40 of the endless corrugated cardboard web 2 are mutually separated. The web portions 39, 40 emanate from the endless corrugated cardboard web 2 and form endless part-webs of the endless corrugated cardboard web 2.

The corrugated cardboard plant, downstream of the turnout 38 in relation to the transportation direction 29, has a register mark detection device 41 for detecting register marks 42 (FIGS. 2 to 5) on the endless corrugated cardboard web 2 or on the web portions 39, 40, respectively.

Figure 2:
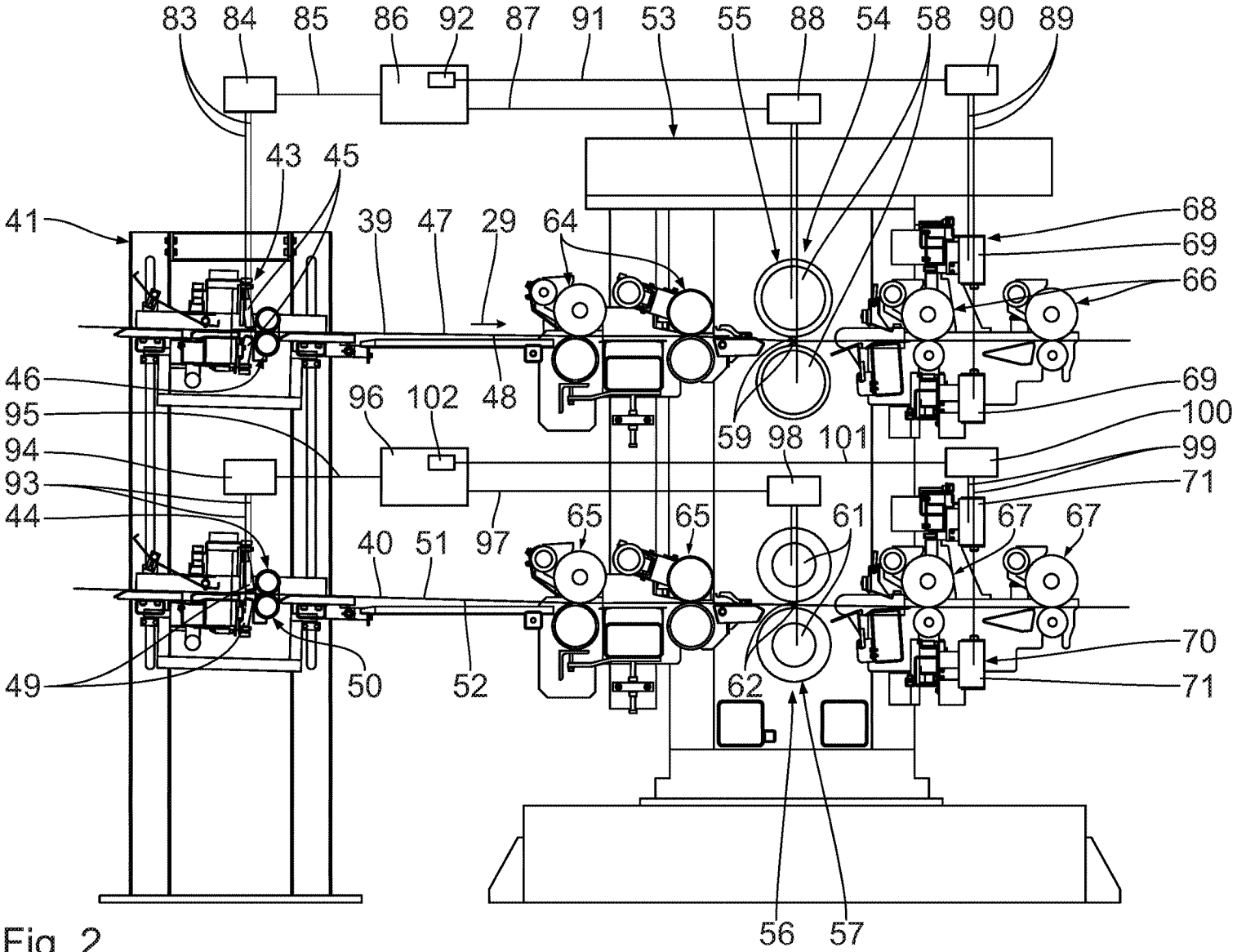
FIG. 2 shows a side view of the register mark detection device and of the register mark cutting device of the corrugated cardboard plant shown in FIG. 1.

As is shown in FIG. 2 in which the register mark detection device 41 according to FIG. 1 is visualized in detail, the register mark detection device 41 has a first upper register mark detection installation 43 and a second lower register mark detection installation 44. The first register mark detection installation 43 is assigned to the first web portion 39 for detecting register marks 42 on the latter, while the second register mark detection installation 44 is assigned to the second web portion 44 for detecting register marks 42 on the latter.

The first register mark detection installation 43 has two mutually opposite first register mark detection sensors 45 which are disposed so as to be adjacent and, in relation to the transport direction 29, upstream of a first guide roller pair 46 for guiding the first web portion 39. The first web portion 39 is guided through between the two first register mark detection sensors 45. The first register mark detection sensors 45 herein acquire the upper side 47 and the lower side 48 of the first web portion 39.

The second register mark detection installation 44 is configured in a manner corresponding to that of the first register mark detection installation 43. Said second register mark detection installation 44 comprises two second register mark detection sensors 49 which are disposed so as to be adjacent and, in relation to the transportation direction 29, upstream of a second guide roller pair 50 for guiding the second web portion 40. The second web portion 40 is guided through between the two second register mark detection sensors 49. The second register mark detection sensors 49 acquire the upper side 51 and the lower side 52 of the second web portion 40.

A register mark cutting device 53 which is again illustrated in a simplified manner in FIG. 1 and in detail in FIG. 2, is disposed downstream of the register mark detection device 41 in relation to the transportation direction 29. The register mark cutting device 53 is disposed so as to be adjacent to the register mark detection device 41. Said register mark cutting device 53 has a first register mark cutting installation 54 having a first register mark cutting roller pair 55 for the first web portion 39, and a second register mark cutting installation 56 having a second register mark cutting roller pair 57 for the second web portion 40.

Figure 3:
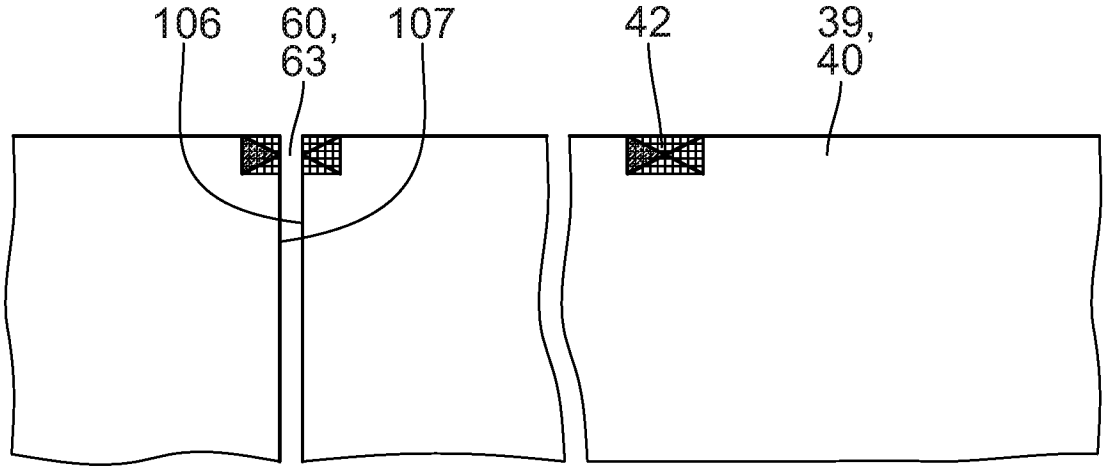
FIG. 3 shows a plan view of a corrugated cardboard web which has been severed in an orderly fashion by means of a register mark cut of the register mark cutting device according to FIG. 1 or 2, respectively.
Figure 4:
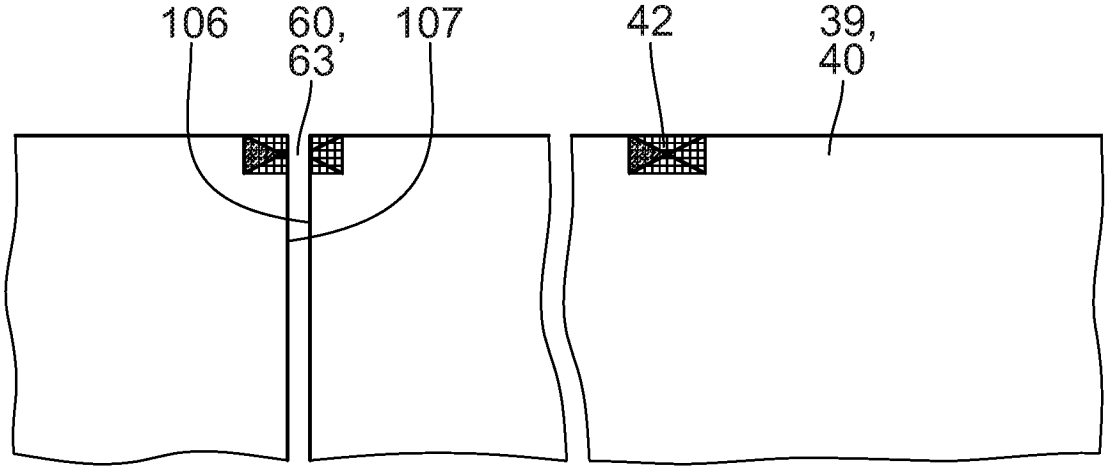
FIGS. 4, 5 show the corrugated cardboard web shown in FIG. 3, wherein the register mark cuts have been carried out in a defective manner.
Figure 5:
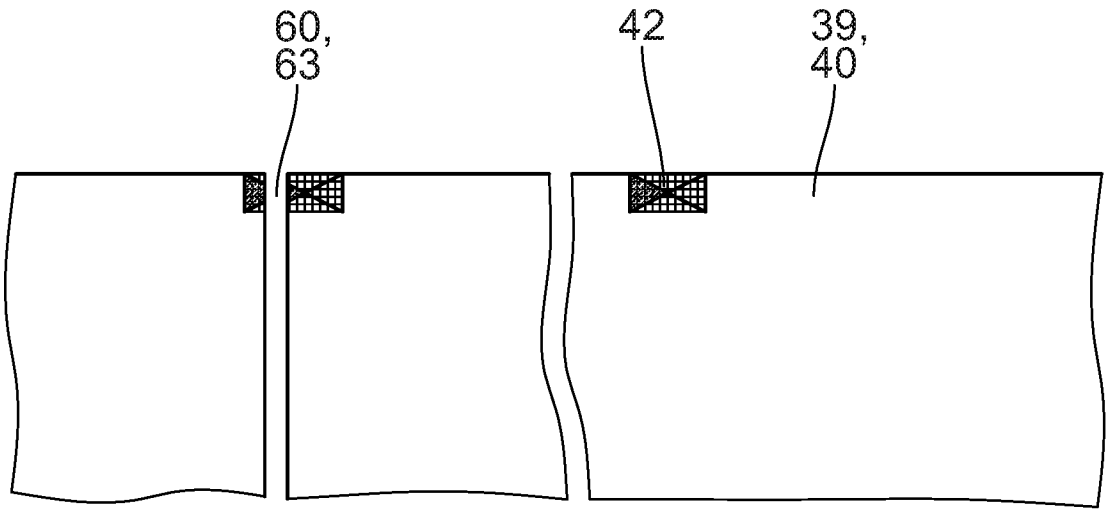

Each first roller 58 of the first register mark cutting roller pair 55 supports a first blade beam 59 that extends in a radially outward manner and runs perpendicularly to the transportation direction 29. The first blade beams 59 interact for transversely severing the first web portion 39 while forming a second register mark cut 60 (FIGS. 3 to 5).

Each second roller 61 of the second register mark cutting roller pair 57 supports a second blade beam 62 that extends in a radially outward manner and runs perpendicularly to the transportation direction 29. The second blade beams 62 interact for transversely severing the second web portion 40 while forming a second register mark cut 63.

Each register mark cutting roller pair 55, 57 is rotatably driveable by a motor. In particular, the rollers 58, 61 of the respective register mark cutting roller pair 55 or 57, respectively, are rotatingly driveable about the central axis thereof by way of the motors.

Two first introduction roller pairs 64 for introducing the first web portion 39 in a precise manner into the first register mark cutting installation 54 are disposed upstream of the first register mark cutting installation 54 in relation to the transportation direction 29. The first web portion 39 is guided through the first introduction roller pairs 64.

Two second introduction roller pairs 65 for introducing the second web portion 40 in a precise manner into the second register mark cutting installation 56 are disposed upstream of the second register mark cutting installation 56 in relation to the transportation direction 29. The second web portion 40 is guided through the second introduction roller pairs 65.

Two first delivery roller pairs 66 in relation to the transportation direction 29 are disposed downstream of the first register mark cutting installation 54, the former serving for delivering the first web portion 39 in a precise manner The first web portion 39 is guided through the first delivery roller pairs 66.

Two second delivery roller pairs 67 in relation to the transportation direction 29 are disposed downstream of the second register mark cutting installation 56, the former serving for delivering the second web portion 40 in a precise manner. The second web portion 39 is guided through the second delivery roller pairs 67.

A first register mark cut detection installation 68 for detecting the first register mark cut 60 in the first web portion 39 is disposed between the first delivery roller pairs 66. The first register mark cut detection installation 68 is formed by two mutually opposite first register mark cut detection cameras 69, the first web portion 39 being guided in the transportation direction 29 between said first register mark cut detection cameras 69. The first register mark cut detection cameras 69 acquire both the upper side 47 as well as the lower side 48 of the first web portion 39.

A second register mark cut detection installation 70 for detecting the second register mark cut 63 in the second web portion 40 is disposed between the second delivery roller pairs 67. The second register mark cut detection installation 70 is formed by two mutually opposite second register mark cut detection cameras 71, the second web portion 40 being guided in the transportation direction 29 between said second register mark cut detection cameras 71. The second register mark cut detection cameras 71 acquire the upper side 51 and the lower side 52 of the second web portion 40.

The register mark cut detection installations 68, 70 form a register mark cut detection assembly.

The register mark cutting installations 54, 56, the register mark cut detection installations 68, 70, the introduction roller pairs 64, 65, and the delivery roller pairs 66, 67 are favourably disposed on a common machine frame.

A conveyor belt assembly 72 is disposed downstream of the register mark cutting device 53. The conveyor belt assembly 72 has a first conveyor belt 73 that is guided about rotatably driveable first rollers 74. The first conveyor belt 73 serves for conveying first corrugated cardboard sheets 75 which by means of the first register mark cutting installation 54 have been generated from the first web portion 39. The first corrugated cardboard sheets 75 are conveyed in an imbricated manner on the first conveyor belt 73 to a first depository 76 where said first corrugated cardboard sheets 75 are stacked to form a first stack 77.

The conveyor belt assembly 72 comprises a second conveyor belt 76 which is guided about rotatably driveable second rollers 79. The second conveyor belt 78 serves for conveying second corrugated cardboard sheets 80 which by means of the second register mark cutting installation 56 have been generated from the second web portion 40. The second corrugated cardboard sheets 80 are conveyed in an imbricated manner on the second conveyor belt 78 to a second depository 81 where said second corrugated cardboard sheets 80 are stacked to form a second stack 82.

The actuation of the register mark cutting device 53 will be explained in more detail hereunder. The web portions 39, 40 are in each case transported in the transportation direction 29. Said web portions 39, 40 herein pass the first register mark detection installation 43 or the second register mark detection installation 44, respectively.

Corresponding first register mark signals of the register marks 42 on the first web portion 39 that are acquired by the first register mark detection sensors 45 are supplied by way of first signal lines 83 to a first electronic information processing installation 84.

The first information processing installation 84 by way of a second signal line 85 is in signal connection with a first control assembly 86. The first control assembly 86 receives respective signals from the first information processing installation 84.

The first control assembly 86 in turn by way of a third signal line 87 is in signal connection with a first drive motor 88 of the first register mark cutting installation 54 in order for the first register mark cutting roller pair 55 to be rotatingly driven in a corresponding manner. The first drive motor 88 thus receives respective cutting signals from the first control assembly 86 in order for the first web portion 39 to be cut into the first corrugated cardboard sheets 75. This cutting procedure is triggered by the detected register marks 42.

The first register mark cut detection installation 68 herein acquires the respective first register mark cut 60 generated. Respective register mark cut position signals are supplied to a first register mark cut position evaluation installation 90 by way of fourth signal lines 89. The first register mark cut position evaluation installation 90 evaluates whether the first register mark cut 60 generated has been carried out in an orderly fashion in relation to the register marks 42. In the affirmative, no correction or modification respectively, of the first register mark cutting installation 54 is performed. In the negative, correction signals by way of a fifth signal line 91 are supplied to a first register mark cut position correction installation 92. The first register mark cut position correction installation 92 is favourably a component part of the first control assembly 86 and ensures an actuation of the first register mark cutting installation 54 in a correspondingly corrected manner.

A register mark cut 60, 63 carried out in an orderly fashion is shown in FIG. 3. The register mark cut 60, 63 has been carried out precisely in relation to the associated register mark 42. In particular, said register mark cut 60, 63 has been carried out so as not to be offset in the transportation direction 29 or counter to the transportation direction 29 in relation to the respective register mark 42. Defective register mark cuts 60, 63 are illustrated in FIGS. 4, 5. Said defective register mark cuts 60, 63 are offset in or counter to the transportation direction 29, respectively, as is shown by the register marks 42 that have been severed in an offset manner.

The actuation of the second register mark cutting installation 56 is performed in analogous manner. Corresponding second register mark signals of the register marks 42 on the second web portion 40 that are acquired by the second register mark detection sensors 49 are supplied to a second electronic information processing installation 94 by way of sixth signal lines 93.

The second information processing installation 94 by way of a seventh signal line 95 is in signal connection with a second control assembly 96. The second control assembly 96 receives respective signals from the second information processing installation 94.

The second control assembly 96 in turn by way of an eighth signal line 97 is in signal connection with a second drive motor 96 of the second register mark cutting installation 56 in order for the second register mark cutting roller pair 57 to be rotatingly driven in a corresponding manner. The second drive motor 98 thus receives respective cutting signals from the second control assembly 96 in order for the second web portion 40 to be cut into the second corrugated cardboard sheets 80. This cutting procedure is triggered by the detected register marks 42.

The second register mark cut detection installation 70 herein acquires the respective second register mark cut 63 generated. Respective register mark cut position signals are supplied to a second register mark cut position evaluation installation 100 by way of ninth signal lines 99. The second register mark cut position evaluation installation 100 evaluates whether the second register mark cut 63 generated has been carried out in an orderly fashion in relation to the register marks 42. In the affirmative, no correction or modification respectively, of the second register mark cutting installation 56 is performed. In the negative, correction signals by way of a tenth signal line 101 are supplied to a second register mark cut position correction installation 102. The second register mark cut position correction installation 102 is favourably a component part of the second control assembly 96 and ensures an actuation of the second register mark cutting installation 56 in a correspondingly corrected manner.

Defective register mark cuts 60, 63 are illustrated in FIGS. 4, 5. Said defective register mark cuts 60, 63 are offset in or counter to, respectively, the transportation direction 29.

Figure 9:
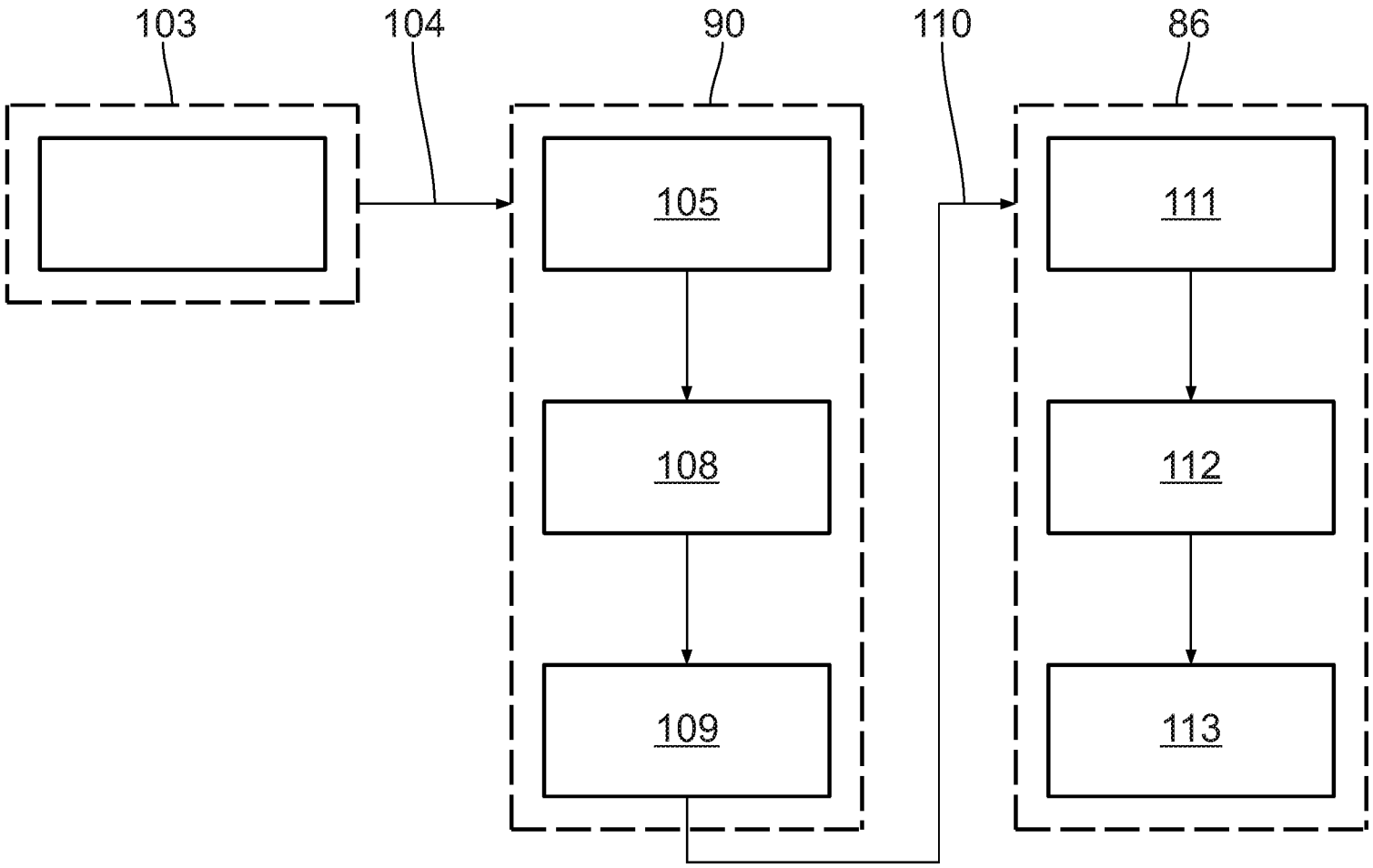
FIG. 9 shows a block diagram which visualises the sequence of the register mark cut position correction of the corrugated cardboard plant according to FIG. 1.

The register mark cut position correction by means of the first register mark cutting installation 54 will be explained once again in more detail hereunder with reference to FIG. 9. The correction takes place analogously by means of the second register mark cutting installation 56.

In a first step 103, the first conveyed corrugated cardboard sheets 75 are recorded by means of the first register mark cut detection cameras 69. Adjacent corrugated cardboard sheets 75 are favourably disposed so as to be mutually spaced apart.

In a second step 104, the images that have been recorded by the first register mark cut detection cameras 69 are transmitted by way of the fourth signal lines 89 to the first register mark cut position evaluation installation 90.

As the third step 105, the cutting edges 106, 107 generated by the first register mark cutting installation 54 on first corrugated cardboard sheets 75 that are disposed so as to be adjacent are detected in an image processing unit of the register mark cut position evaluation installation 90. The cutting edges 106, 107 run so as to be adjacent and mutually parallel As the step 108, the register mark 42 that is associated with the register mark cut 60 is detected in the first register mark cut position evaluation installation 90. Step 108 can be performed prior to or after step 105.

As the next step 109, the spacing of the cutting edges 106, 107 from the associated register mark 42 in the transportation direction 29 or counter thereto, is determined in the first register mark cut position evaluation installation 90. To this end, a spacing measuring unit of the register mark cut position evaluation installation 90 is utilized.

As the next step 110, respective spacing signals are transmitted by way of the fifth signal line 91 to the first control assembly 86.

As the next step 111, a comparison of the spacing of the cutting edges 106, 107 from the associated register mark 42 with a tolerable register mark offset is performed from order data in said first control assembly 86. To this end, the first control assembly has a respective spacing comparison unit.

As the next step 112, a register mark cut position correction is computed if required in the first control assembly 86. A respective computer unit is present to this end.

As the next step 113, a correction or repositioning, respectively, of the first register mark cut 60 is performed if required by means of the first register mark cut position correction installation 92 by way of a modified actuation of the first register mark cutting installation 54.

The correction of the second register mark cutting installation 56 is performed in an analogous manner.

The signal connections or signalling lines, respectively, stated can be embodied in a wireless or wire-bound manner.

Figure 6:
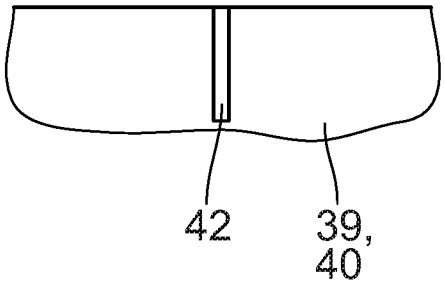
FIGS. 6-8 show alternative embodiments of register marks.
Figure 7:
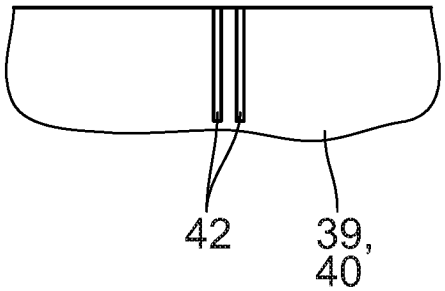
Figure 8:
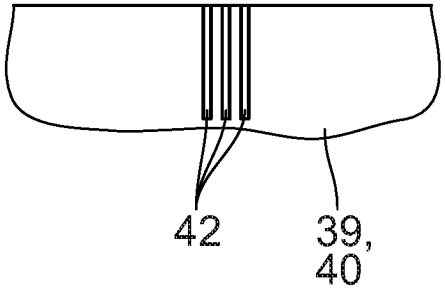

FIGS. 6 to 8 show alternative embodiments of register marks 42 that can be used. According to FIG. 6, this register mark 42 is formed by precisely one bar that runs perpendicularly to the transportation direction 29.

According to FIG. 7, each register mark 42 is formed by two bars which run so as to be mutually parallel. Said two bars are disposed so as to be mutually spaced apart in the transportation direction 29 and run perpendicularly to the adjacent longitudinal edge.

According to FIG. 8, three bars which run so as to be mutually parallel and in the transportation direction 29 are disposed so as to be mutually equidistant are present.

What is claimed is:

1. A corrugated cardboard plant, comprising a corrugated cardboard web production assembly for producing a corrugated cardboard web;

a register mark cutting device, disposed downstream of the corrugated cardboard web production assembly, for cutting the corrugated cardboard web into corrugated cardboard sheets;

a register mark detection device, disposed upstream of the register mark cutting device, for detecting at least one register mark on the corrugated cardboard web;

a control assembly which i. is in signal connection with the register mark cutting device;

ii. is in signal connection with the register mark detection device;

and iii. depending on the at least one detected register mark actuates the register mark cutting device for cutting the corrugated cardboard web into the corrugated cardboard sheets, while generating at least one register mark cut;

a register mark cut detection assembly, disposed downstream of the register mark cutting device, for detecting the at least one register mark cut;

a register mark cut position evaluation installation for evaluating a position of the at least one register mark cut in relation to the at least one associated register mark; and a register mark cut position correction installation for automatic correction of a position of the at least one register mark cut in relation to the at least one register mark in the case of an undesirable deviation of a position of the at least one register mark cut.

2. A corrugated cardboard plant according to claim 1, wherein the register mark cut detection assembly is configured as a camera assembly.

3. A corrugated cardboard plant according to claim 1, wherein the register mark cut detection assembly comprises a register mark cut detection installation, facing an upper side of the corrugated cardboard sheets, for detecting the upper side of the corrugated cardboard sheets, and a further register mark cut detection installation, facing a lower side of the corrugated cardboard sheets, for detecting the lower side of the corrugated cardboard sheets.

4. A corrugated cardboard plant according to claim 1, wherein the register mark cut detection assembly is disposed upstream of a depository for depositing the corrugated cardboard sheets in stacks.

5. A corrugated cardboard plant according to claim 1, wherein the register mark cut position evaluation installation comprises an image processing unit.

6. A corrugated cardboard plant according to claim 1 wherein the register mark cut position evaluation installation comprises a spacing measuring unit for measuring at least one spacing between at least one register mark cutting edge on the at least one corrugated cardboard sheet generated, and the at least one associated register mark.

7. A corrugated cardboard plant according to claim 1, wherein the register mark cut position correction installation is in signal connection with the register mark cut position evaluation installation and the register mark cutting device.

8. A corrugated cardboard plant according to claim 1 comprising a nominal interval parameter unit for correcting a position of the at least one register mark cut in the case of a deviation from a nominal interval.

9. A corrugated cardboard plant comprising:

a corrugated cardboard web production assembly for producing a corrugated cardboard web;

a register mark cutting device, disposed downstream of the corrugated cardboard web production assembly, for cutting the corrugated cardboard web into corrugated cardboard sheets;

a register mark detection device, disposed upstream of the register mark cutting device, for detecting at least one register mark on the corrugated cardboard web;

a control assembly in signal connection with the register mark cutting device and in signal connection with the register mark detection device and configured to actuate the register mark cutting device to control a cutting of the corrugated cardboard web into the corrugated cardboard sheets while generating at least one register mark cut based on the at least one detected register mark;

a register mark cut detection assembly, disposed downstream of the register mark cutting device, for detecting the at least one register mark cut;

a register mark cut position evaluation installation for evaluating a position of the at least one register mark cut in relation to the at least one associated register mark; and a register mark cut position correction installation for automatic correction of the actuation of the register mark cutting device to correct a position of a subsequent at least one register mark cut based on the evaluation of the position of the at least one register mark cut in relation to the at least one associated register mark.

10. A corrugated cardboard plant according to claim 9, wherein the register mark cut detection assembly is configured as a camera assembly.

11. A corrugated cardboard plant according to claim 9, wherein the register mark cut detection assembly comprises a register mark cut detection installation, facing an upper side of the corrugated cardboard sheets, for detecting the upper side of the corrugated cardboard sheets, and a further register mark cut detection installation, facing a lower side of the corrugated cardboard sheets, for detecting the lower side of the corrugated cardboard sheets.

12. A corrugated cardboard plant according to claim 9, wherein the register mark cut detection assembly is disposed upstream of a depository for depositing the corrugated cardboard sheets in stacks.

13. A corrugated cardboard plant according to claim 9, wherein the register mark cut position evaluation installation comprises an image processing unit.

14. A corrugated cardboard plant according to claim 9, wherein the register mark cut position evaluation installation comprises a spacing measuring unit for measuring at least one spacing between at least one register mark cutting edge on at least one corrugated cardboard sheet generated, and the at least one associated register mark.

15. A corrugated cardboard plant according to claim 9, wherein the register mark cut position correction installation is in signal connection with the register mark cut position evaluation installation and the register mark cutting device.

16. A corrugated cardboard plant according to claim 9, comprising a nominal interval parameter unit for correcting a position of the at least one register mark cut in the case of a deviation from a nominal interval.

17. A method for production of corrugated cardboard sheets, comprising producing a corrugated cardboard web by means of a corrugated cardboard web production assembly;

cutting the corrugated cardboard web into corrugated cardboard sheets by a register mark cutting device that is disposed downstream of the corrugated cardboard web production assembly;

detecting at least one register mark on the corrugated cardboard web by means of a register mark detection device which is disposed upstream of the register mark cutting device;

actuating the register mark cutting device for cutting the corrugated cardboard web into the corrugated cardboard sheets by means of a control assembly depending on the at least one detected register mark by generating at least one register mark cut, wherein the control assembly is in signal connection with the register mark cutting device and the register mark detection device;

detecting the at least one register mark cut with a register mark cut detection assembly, disposed downstream of the register mark cutting device;

evaluating a position of the at least one register mark cut in relation to the at least one associated register mark with a register mark cut position evaluation installation; and automatically correcting a position of the at least one register mark cut in relation to the at least one register mark in the case of an undesirable deviation of a position of the at least one register mark cut by means of a register mark cut position correction installation.

* * * * *